US009403076B2

(12) United States Patent
McCranor

(10) Patent No.: US 9,403,076 B2
(45) Date of Patent: Aug. 2, 2016

(54) MARTIAL ARTS TRAINING AND SCORING GAME SYSTEM

(71) Applicant: Ian McCranor, Carmel, IN (US)

(72) Inventor: Ian McCranor, Carmel, IN (US)

( * ) Notice: Subject to any disclaimer, the term of this patent is extended or adjusted under 35 U.S.C. 154(b) by 0 days.

(21) Appl. No.: 14/620,416

(22) Filed: Feb. 12, 2015

(65) Prior Publication Data

US 2015/0157913 A1 Jun. 11, 2015

Related U.S. Application Data

(63) Continuation-in-part of application No. 13/304,294, filed on Nov. 23, 2011, now abandoned.

(51) Int. Cl.

| | |
|---|---|
| ***A63B 69/00*** | (2006.01) |
| ***A63B 71/14*** | (2006.01) |
| ***A63B 63/00*** | (2006.01) |
| ***A63B 71/10*** | (2006.01) |
| ***A63B 71/12*** | (2006.01) |
| ***A63B 71/06*** | (2006.01) |

(52) U.S. Cl.

CPC ..... *A63B 69/004* (2013.01); *A63B 63/003* (2013.01); *A63B 71/10* (2013.01); *A63B 71/12* (2013.01); *A63B 71/14* (2013.01); *A63B 71/141* (2013.01); *A63B 2071/0694* (2013.01); *A63B 2209/10* (2013.01)

(58) Field of Classification Search

CPC ..... A63B 69/004; A63B 69/20–69/34; A63B 63/003; A63B 71/12; A63B 2209/10

USPC ..... 482/83–90; 273/348.3, 348.4

See application file for complete search history.

(56) References Cited

U.S. PATENT DOCUMENTS

| | | | | |
|---|---|---|---|---|
| 4,305,587 | A * | 12/1981 | O'Grady | A63F 9/0208 273/348.3 |
| 4,653,582 | A * | 3/1987 | Ehrenfried | 116/222 |
| 5,996,116 | A * | 12/1999 | Tate | A01K 97/06 2/12 |
| 2002/0077223 | A1 * | 6/2002 | Zai | 482/83 |
| 2008/0098797 | A1 * | 5/2008 | Considine et al. | 73/12.09 |
| 2009/0048069 | A1 * | 2/2009 | Sheedy | 482/8 |

* cited by examiner

*Primary Examiner* — Oren Ginsberg
*Assistant Examiner* — Jennifer M Deichl
(74) *Attorney, Agent, or Firm* — C. John Brannon; Brannon Sowers & Cracraft PC

(57) ABSTRACT

A kit for combatants engaged in a martial arts competition, including a combat garment for generally covering the combatant, strike gear for covering at least portions of the combatants hands and feet, and strike coins for loosely adhering to portions of the combat garment. The combat garment includes a plurality of predetermined areas covered with first hook-and-loop fasteners. Each predetermined area corresponds with a predetermined strike zones. At least a portion of the strike gear is covered with second hook-and-loop fasteners and each respective strike coin is covered with third hook-and-loop fasteners adhesively matable with the first and second hook-and-loop fasteners.

14 Claims, 3 Drawing Sheets

MARTIAL ARTS TRAINING AND SCORING GAME SYSTEM

CROSS-REFERENCE TO RELATED APPLICATIONS

This patent application is a continuation-in-part of, and claims priority benefit to, co-pending U.S. patent application Ser. No. 13/304,294, filed on Nov. 23, 2011.

TECHNICAL FIELD

This specification relates to the facilitation of martial arts training and in particular to martial arts training devices and scoring devices.

BACKGROUND

The martial arts, such as karate, kung-fu, tae-kwon do, kick-boxing, boxing, and others, enjoy increasing popularity as physical sports and mental disciplines. Many of these martial arts are the present day successors of ancient forms of hand to hand combat. As such, the martial arts can require the development of split-second reflexes, requiring practitioners to perceive, analyze and react to a given situation rapidly.

Typically, martial arts are taught utilizing instruction and practice techniques that encourage competition and rivalry among the practitioners. Often, martial arts instructors employ full-contact contest formats and/or non-contact or light contact (controlled) sparring sessions as part of the training sessions. However, the speeds, skills, and movements involved can make scoring such contests or training sessions problematic. In short, scoring is predicated on the subjective evaluation of an exchange of techniques between the participants, either by the participants themselves, or by others. Dependence on subjective judgement in conjunction with the speed, skills and movements can result in improperly scored sessions, contests and/or rankings. Additionally, improper scoring and/or ranking can encourage excessive contact (by a participant attempting to forcefully "record" his strike unmistakably for the evaluator).

Similarly, the ranking of participants is also problematic. Many of the martial arts utilize an advancement system to acknowledge a practitioner's knowledge and skill in an art. For example, many forms of Karate utilize a belt color system where the color of a practitioner's belt denotes the practitioner's tested knowledge and skill in the art. However, such systems do not lend themselves to individually ranking practitioners against other practitioners of the same belt rank. Likewise, such ranking systems do not readily permit the identification of victories in past competition sessions.

Thus, there is a need for a means and method for improved scoring and ranking of participants in martial arts training and competitive matches. The present invention addresses this need.

SUMMARY

This specification describes technologies relating to a means and method of scoring and ranking martial arts practitioners.

In general, one innovative aspect of the novel technology presented in this specification is a game rules and scoring system for use in various styles of martial arts, including a garment partially covering a combatant and possessing a plurality of areas covered with easily detachable/reattachable fasteners, such as hook and loop type fasteners or the like, each of the areas corresponding to a strike location upon the combatant. The garment also includes strike gear, the strike gear likewise covered with like fasteners, and strike coins or flags, wherein each strike coin is covered with fasteners matable to the garment and strike gear fasteners. Each strike coin has an associated point value based upon a determined strike location of the combatant that the strike coin is affixed to.

In general, another innovative aspect of the novel technology presented in this specification is an outfit for combatants engaged in a martial competition comprising a garment consisting of a first gear, a second gear and strike coins, the first gear consisting of a resilient material and possessing a plurality of areas covered with hook and loop type fasteners, each of the hook and loop type fastener covered areas corresponding to a strike location upon a combatant equipped with the first gear, and the second gear covering strike elements of the combatant consisting of a resilient material and also substantially covered with hook and loop type fasteners, and the second gear covering the strike elements of the combatant and consisting of a resilient material substantially covered with hook and loop type fasteners, and the score coins consisting of a thin and resilient material and substantially covered with hook and loop type fasteners, and each strike coin being associated with a point value based upon a strike location of the combatant that the strike coin is proximate to, wherein the hook and loop fasteners on the second gear are such that an adhesion between a strike coin and the second gear is stronger than an adhesion between the strike coin and the first gear.

In general, another aspect of the subject matter described in this specification can be embodied in methods that include the actions of equipping each combatant in a martial arts training session or competition session with a first gear, the first gear covering at least one strike location, wherein a portion of the first gear is covered with a loop material for interlocking engagement with a score coin, further equipping each combatant with a second gear, the second gear covering at least one strike element, wherein a portion of the second gear is covered with a loop material for interlocking engagement with a score coin, and equipping at least one combatant with at least one score coin, the at least one score coin equipped such that the at least one score coin is interlockingly engaged with the first gear in close proximity of the at least one strike location, then running a combat session wherein each combatant participates in the combat session, and generating a score for each combatant primarily based upon a sum of score coins, each of the score coins interlockingly engaged with the second gear upon the combatant.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
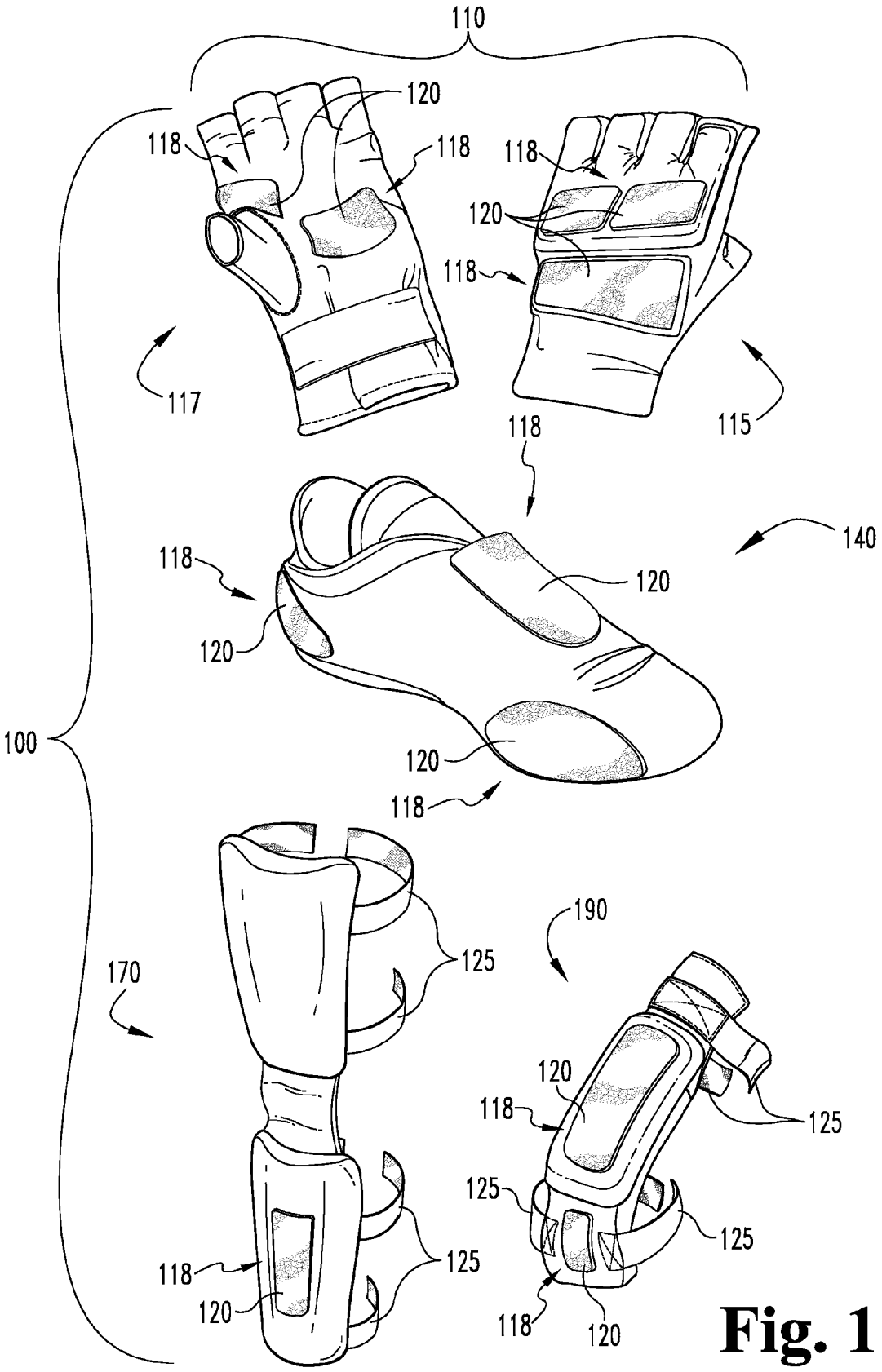
FIG. 1 is a plan view of strike gear, in accordance with one embodiment of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

FIGS. 1-4 illustrate a first embodiment of the present novel technology, the physical components of a martial arts game system 10. FIG. 1 is a plan view of strike gear 100, in accordance with one embodiment of the game system 10. Strike gear 100 covers the strike target portions or elements of the body of a player or competitor—the target elements of the body that are used in striking or performing martial arts techniques. FIG. 1 portrays the plan view of the top 115 and the palm side 117 of a left strike glove 110, a side view of a strike booty 140, a front view of a strike knee and shin guard 170, and an elbow and forearm strike sleeve 190. The right strike glove no is a mirror image of the left strike glove no and is not portrayed in FIG. 1. While only a single strike glove no, strike booty 140, shin guard 170, and an elbow and forearm strike sleeve 190 are shown, the typical implementation includes mirror image pairs of one or more of the strike coverings 110, 140, 170, 190.

Strike gear 100 is typically formed of a resilient material and padded to enhance the safety to both the striking and receiving combatants or practitioners. In some implementations, the resilient material and padding are the same material. For example, some implementations utilize a durable foam rubber with the outer surface coated with a thin, protective covering of rubber. Other implementations utilize a resilient material that is sown to form the protective gear and to encapsulate the padding. In such implementations, the resilient material is preferably double stitched. However, other means of fastening such as fusing the resilient material, gluing the resilient material, form molding the resilient material, and the like can be utilized. The strike glove no may be a full glove, covering the entire hard, or a partial glove or band covering a portion of the hand. Likewise, the strike booty 140 may cover more or less of the foot.

In FIG. 1, the strike glove 110 is shown separate from the elbow and forearm strike sleeve 190 which serves to cover the combatant's forearm and elbow. However, some implementations have the strike glove 110 and the elbow and forearm strike sleeve 190 in one-piece. Similarly, while the strike booty 140 and the strike knee and shin guard 170 are drawn separately, some implementations also have the strike booty 140 and the strike knee and shin guard 170 in one piece. The strike gear 100 may also include strike wear 195 that may be worn or other body parts that may be used for striking such as the forehead, as practiced in different martial arts.

In some implementations, the strike glove 110 has multiple offensive strike areas 118. The strike booty 140, the elbow and forearm strike sleeve 190 and the strike knee and shin guard 170 also have multiple offensive strike areas 118. It should be noted that the term strike area 118 is not limiting and that the martial arts training and scoring gear is also operable for non-strike contact-based martial arts techniques.

The multiple offensive strike areas 118 are covered with contact based fasteners 120. Typically, the contact based fasteners 120 are repeatedly disengageably reengagable permitting the means of fastening 120 to be reused. The contact based fasteners 120 are such that upon contact with a strike coin, the strike coin securely attaches to the strike gear 100. In some implementations, the contact based fasteners 120 are hook and loop type fasteners. In some implementations, the contact based fasteners 120 are composed of an elastomer, sufficiently sticky such that upon contact with a strike coin 300, the strike coin 300 securely attaches to the strike gear 100. In some other implementations, the contact based fasteners 120 are composed of magnets and magnetic substances such that upon contact with a strike coin 300, the strike coin 300 securely attaches to the strike gear 100. Notwithstanding the implementations, the strike coins 300 are more adhesive to the strike gear 100 than to the combat garment 200.

However, different martial arts differ in the number and size of strike locations 118 upon the various parts of the body used to strike with. As such, some implementations have different strike locations 118 upon the strike gear 100. Some implementations even cover the entire surface of the strike gear 100 with contact based fasteners 120. This permits a strike coin 300 to affix to any portion of the strike gear 100.

In some implementations, one or more of the strike gear 100 may have attachment devices 125 with which the strike gear 100 is attached to a combatant. Typically, the attachment devices 125 are straps with hook and loop type fasteners placed upon the straps in such way such that the straps can be adjustably secured to the combatants. However, any suitable means to secure the strike gear 100 to a combatant can be used. For example, the strike booty 140, the elbow and forearm strike sleeve 190 and the strike knee and shin guard 170 can utilize an elastic sock style means of securing the respective piece of strike gear 100, with the elastic sock snuggly fitting over the respective body part to secure the respective piece of strike gear 100.

Figure 2:
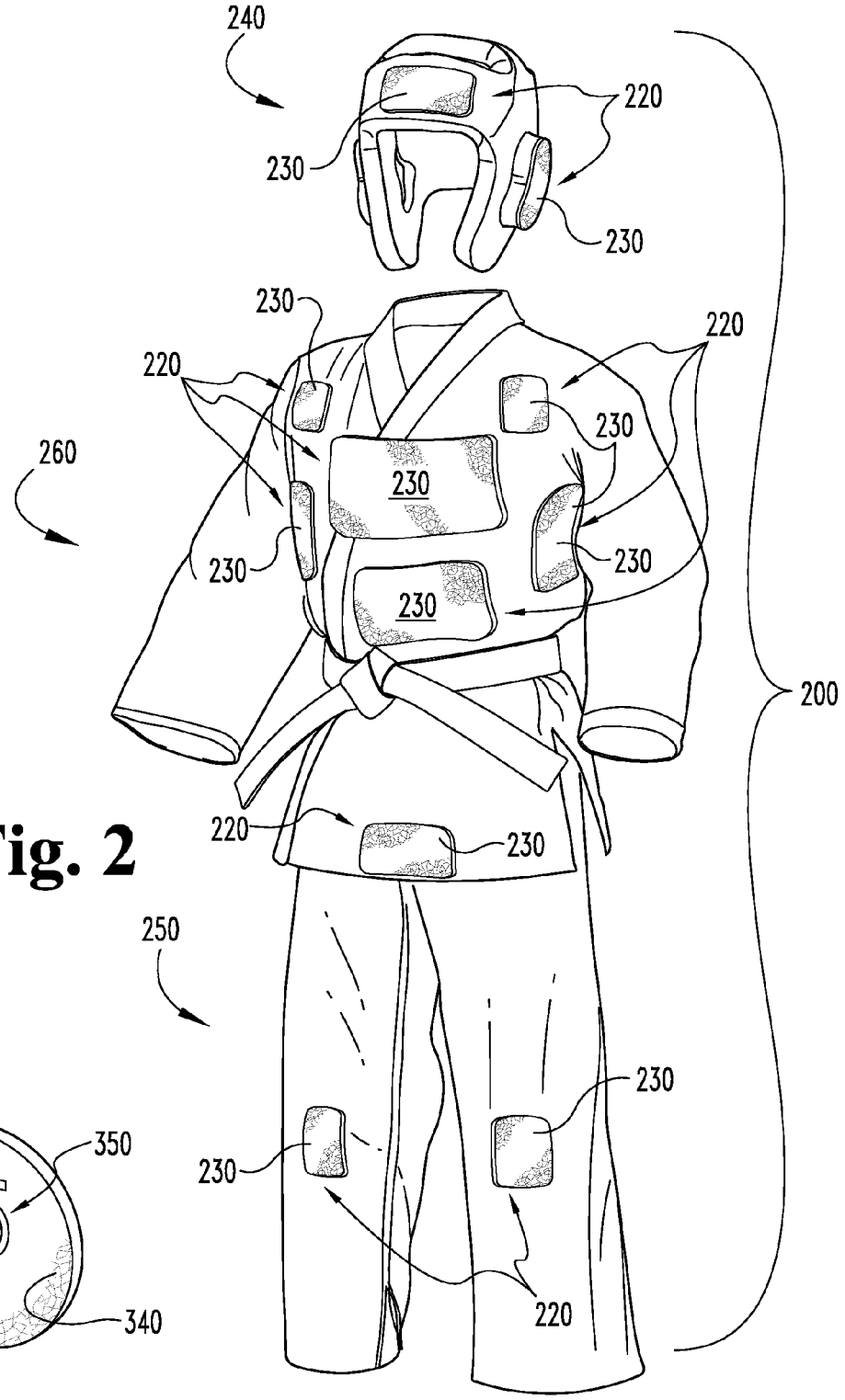
FIG. 2 is a plan view of a combat garment, in accordance with one embodiment of the present novel technology.

FIG. 2 is a plan view of a combat garment 200, in accordance with one embodiment of the present novel technology. While depicted as a protective head covering 240 and a pants 250 and tunic or shirt 260 like covering, examples of other implementations include the combat garment 200 being a one piece jumpsuit like design, a robe like design, a belted robe like design, a large shirt like design, and the like. Similar to the strike gear 100, the combat garment 200 is typically composed of a resilient material. Example resilient materials for the combat garment 200 include heavy cloth and fiber clothing materials such as rip stop nylon, burlap, heavy cotton, and the like. Additionally, the head covering 240 may also be composed of a padded material. For example, the head covering 240 of some implementations utilize a durable foam rubber with the outer surface coated with a thin, protective covering of rubber.

Similar to the strike gear 100, the combat garment 200 has multiple strike zones 220. Typically, the strike locations 220 correspond to vital strike areas of the human body. For example, strike locations 220 can include the knee, the temples of the head, the ears, the groin, various nerve and joint locations, and the like. However, some implementations have strike locations 220 that do not correspond to vital strike areas of the human body. Additionally, some implementations are such that any area of the combat garment 200 is considered a strike location 220. Note that not all strike locations 220 are equal. Some strike locations 220, typically because of the sensitivity of the corresponding location of the body, are considered more important than others. As will be explained below, each strike zone 220 can be associated with a point score, usually corresponding to the strike sensitivity of the corresponding location on the human body.

The strike zones 220 are covered with contact based fasteners 230. Typically, the contact based fasteners 220 are reattachably disengageable, permitting the means of fastening to be reused. The contact based fasteners 230 are such that upon contact with a strike coin 300, the strike coin 300 securely attaches to the combat garment 200. However, the contact based fasteners 230 differ from the contact based fasteners 120 in that a strike coin 300 will attach more securely to the contact based fasteners 120 than to the contact based fasteners 230. In other words, a strike coin 300 will adhere more strongly to strike gear 100 than to the combat garment 200.

However, some implementations do not utilize strike zones upon the combat garment 200. Instead, substantially all or the entire combat garment 200 can be covered with contact based fasteners 230. Substantially covering the entire garment 200 with contact based fasteners 230 enable free placement of the strike coins 300. Additionally, similar to the contact based fasteners 120, the contact based fasteners 230 can be composed of hook and loop type fasteners, magnetic and magnetic elements based fasteners, and/or elastomer based fasteners, or a combination of the three types of fasteners.

Figure 3:
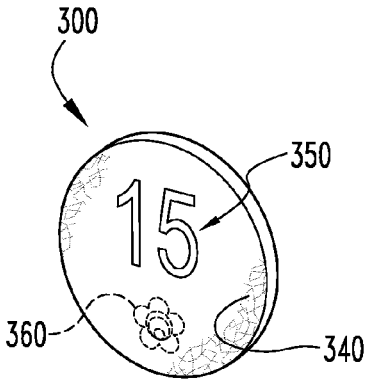
FIG. 3 is a plan view of a strike coin, in accordance with one embodiment of the present novel technology.

FIG. 3 is a plan view of a strike coin or flag 300, in accordance with one embodiment of the present novel technology. A strike coin 300 may also be known by the term score coin. The strike coin 300 is typically composed of a thin and resilient material. Some implementations also use a thin and resilient material that is also flexible. The size of the strike coin 300 may typically vary between one half inch and eight inches, and typically being between two to six inches, although the strike coins 300 may be sized larger or smaller, as desired. For example, in matches between two less experienced competitors, each competitor may wear larger strike coins 300, which in matches between more experienced competitors, each competitor may wear smaller strike coins so as to require advanced skill to strike a smaller target 300, wherein each competitor is of roughly equal skill. If a competitor is trying to hone his defensive skills, he may opt to wear larger coins 300, while if he is trying to hone his offensive skills, he may opt for his opponent to wear smaller coins 300.

Additionally, the term "strike coin" should not be understood to be overly restrictive. Strike coins 300 may vary in shape. For example, in some implementations the strike coin 300 is square or rectangle in shape. In some implementations the strike coin 300 is circular in shape. In still other implementations, the strike coin 300 is star-like in shape. Furthermore, in some implementations the shape and/or the size of the strike coin 300 are based upon the individual who owns the strike coin 300. For example, a novice practitioner might wear strike coins 300 that present a smaller target such as small and circular in shape while a more experienced player might have strike coins 300 that present a larger target such as large, star shaped strike coins 300.

The strike coin 300 is typically covered with a contact-based fastener 340 matable to the contact based fastener 120 and to the contact base fastener 220. Typically, the contact-based fastener 340 matable to the contact based fastener 120 and to the contact base fastener 220 are repeatedly removably disengageable and reengageable, permitting the means of fastening to be reused. Similar to the contact based fasteners 120, the contact-based fastener 340 can be composed of hook and loop type fasteners, magnetic and magnetic elements based fasteners, and/or elastomer based fasteners, or a combination of the three types of fasteners. In some implementations, the contact based fastener 340 of one side of the strike coin 300 forms a less secure attachment to a contact based fastener 120 or a contact based fastener 230 than the other side of the strike coin's 300 attachment to a contact based fastener 120 or a contact based fastener 230.

In some implementations, the strike coin 300 is colored based upon the strike zone 220 that the strike coin 300 is associated with. For example, green strike coins 300 could be placed upon painful but non-lethal strike zones 220, yellow strike coins 300 could be placed upon crippling strike zones 220, and red strike coins 300 could be placed upon lethal strike zones 230. Additionally, the strike coins 300 of some implementations also have an assigned point value 350. Typically, the point value 350 is based upon the severity of the strike zones 220 that the strike coin 300 is associated with. For example, similar to the assigned coin color example, low point value strike coins 300 could be associated with and placed on painful but non-lethal strike zones 220, higher value strike coins 300 could be associated with and placed on the crippling strike zones 220, and high point strike coins 300 could be associated with and placed on lethal strike zones 230.

The strike coins 300 of some implementations can also include additional information. The additional information can be a personal logo 360, a registration symbol, an image, a number, or the like. Additionally, the personal logo 360 itself can be an image, a commercial logo, a registered professional name or mark, or the like. Typically, the personal logo 360 is registered with a nationally recognized entity. The nationally recognized entity ensures that strike coins 300 having the personal logo 360 are given to those who have rights to the personal logo 360. However, in one method of use of the novel technology, such personal logo strike coins 300 can be lost through matches.

For example, a well-known martial artist registers his image as his personal logo 360. Only that well-known martial artist can order additional strike coins 360 bearing his image. When the martial artist enters into competition, he can place his image bearing strike coins 300 on his combat garment 200. His opponent can win the martial artist's strike coins 300 from the martial artist by landing successful strikes on the martial artist. Should his opponent be successful in acquiring the martial artist's strike coins 300 through a match, the opponent can proudly display the martial artist's strike coins 300 to others, possibly as a testament to the opponent's skill.

In general, the novel technology presented in this specification can be used to assist in the training of martial arts, the scoring of martial arts competitions, the evaluating of martial artists, the promoting of martial arts, and helps to decrease the likelihood for injury resulting from practicing or competing in martial arts.

Training in martial arts can take years, require great commitment from the practitioner, and require great levels of precision. Training in martial arts can be a frustrating experience even for the most experienced practitioner. The martial arts training and scoring gear 100, 200, 300 presented in this specification can assist in training a practitioner by visually and potentially selectively highlighting strike zones 220 and by providing performance feedback in real or near real time.

To assist with training, one or more practitioners are equipped with the martial arts training and scoring gear 100, 200, 300. Strike coins 300 are accordingly placed upon the practitioners. Specific colored strike coins 300 can be used to highlight specific strike zones 220 should the practitioners desire to concentrate upon specific strike zones 220. For example, a very bright red can be used to highlight the strike zones 220 associated with a specific martial arts move or strike that the practitioners desire to practice while other colors can be used for the other strike zones 220 upon the practitioners. The practitioners practice martial arts against each other for timed periods. At the end of each time period, the practitioners examine the strike coins 300 that they have taken from each other. Acquired strike coins 300 can optionally be put back upon the respective practitioner at the end of each timed period. Additionally, point values associated with the strike coins 300 can be recorded after each practice session, yielding a value that can be tracked to determine a practitioner's improvement in the art form.

To assist with the scoring of a martial arts competition, one or more of the practitioners are equipped with the martial arts training and scoring gear 100, 200, 300. Strike coins 300 are accordingly placed upon the practitioners. Specific colored or marked strike coins 300 can be used to highlight forbidden or especially important strike zones 220. Typically, the competition is broken up into combat sessions, where each combat session lasts a predetermined time length. Alternatively, competition can be temporarily stopped and each practitioner's acquired strike coins are evaluated for a score. Acquired strike coins 300 can optionally be put back upon the respective practitioner at the end of each timed period. At the end of the competition, each practitioner's scores are added yielding a competition score. Typically, the highest scoring practitioner is considered the winner. However similar to a golf handicap, values can be assigned to unequally skilled practitioners enabling competition to occur between the practitioners.

Additionally, it should be noted that there are other means of tallying up a practitioner's score in both training and in competition. For example, the strike coins 300 that a practitioner loses during training or competition can also be counted. As previously noted, each strike coin 300 can be associated with a specific strike zone 220. Collectively, the values of won strike coins, lost strike coins, and specific won and lost strike coins enables the development of statistics serving to highlight a practitioner's martial arts performance. Furthermore, such statistics are descriptive permitting the statistical evaluation of a practitioner in terms of his preferred areas to strike, to defend and in what areas he is poor at defending. Such values can also be used to statistically model and predict the performance of practitioners.

In this game system 10, it is not possible to score multiple hits to the same target area, such as by a player repeating a single well practiced attack move or by repeatedly exploiting an opponent's weakness. Such multiple hits can only capture a coin 300 once, and once captured, the coin 300 is no longer available for repeat scoring.

Also, use of the martial arts training and scoring gear 100, 200, 300 helps to reduce the chance of injury to practitioners. Unlike the subjective evaluation by a human martial arts judge or instructor, the above mentioned statistics are objective. By using the martial arts training and scoring gear 100, 200, 300, there is no need to increase the force of a kick or punch during a competition or an instruction period to ensure that the human judge or instructor observes the kick or punch. With no need to increase the force of a kick or punch, the forces used during training or competition are likely to be lower and thus lowering the likelihood of injury to practitioners.

It should be understood that the presented novel technology also lends itself to assisting in self or audio or video based instruction. Learning a martial arts technique can require extensive practice, practice that may not be able to be performed in front of an instructor. The novel technology provides positive proof that contact was made. For example, a combat dummy can be equipped with the combat garment 200 presented novel technology. Kicks, strikes, moves, sweeps, and the like can be practiced against the combat dummy. Transfer of strike coins 300 between the combat dummy to the practicing individual would serve to provide nearly instant feedback indicating whether or not the proper location upon the combat dummy was made contact with.

Furthermore, use of the martial arts training and scoring gear 100, 200, 300 enables a verifiable form of promotion of martial arts practitioners. As previously stated, strike coins 300 can be marked with a personal logo 360. Competition between martial arts practitioners can be modified such that the strike coins 300 won or lost by a practitioner remain won or lost. The strike coins 300 won by a practitioner can be examined to see who the practitioner has successfully struck in competition.

Additionally, won strike coins 300 can be worn in future competitions. Similar to trading card games where the participants risk cards that they have won in previous games, practitioners can risk won strike coins 300 by wearing their won strike coins 300 in further matches. Note that wearing won strike coins 300 effectively enables a practitioner to put his reputation on the line during a match by risking, to his competitor, the more valuable or prized strike coins 300 that he has won.

As another variant, participants can declare or randomly decide what strike zones 220 are to be valued before entering into practice or into competition. For example, one or more participants can declare that only strikes to certain strike zones 220 or strike zones 220 of a certain point value or color are to be considered for the participant's combat score. This can allow participants to more intensely focus their martial arts practice to specific strike zones. For example, a participant having trouble with strikes to the head could declare that only his strikes to his opponents head would count for the purpose of his score. That is, only his opponent's score coins 300 corresponding to the strike zones 220 of his opponent's head would count. Other strike coins 300 would not be counted.

While the above detailed description portrays the novel technology in a combat or martial arts light, the presented novel technology should be understood to be applicable to a wide range of activities that involve contact between two or more people. For example, interesting and challenging adaptations of physical games can be enabled through the use of this novel technology. For example, the game of tag can make use of this novel technology. In this example, the participants would be equipped with the gear discussed above. Rules for the game can be implemented for the game permitting only certain types (colors, point values, etc.) of strike coins 300 to be acquired at certain times. The winner of the game could be the individual with the greatest point value.

As another example, the novel technology presented in this specification could be used to assist in teaching competitive dance. Competitive dance activities often require specific moves with high degrees of interaction among the dance partners. Such moves require the specific placement of the partner's hands, arms, legs, feet and the like. The novel technology can be used to provide both feedback and proof of the specific placement of the partner's hands, arms, legs, and the like.

Figure 4:
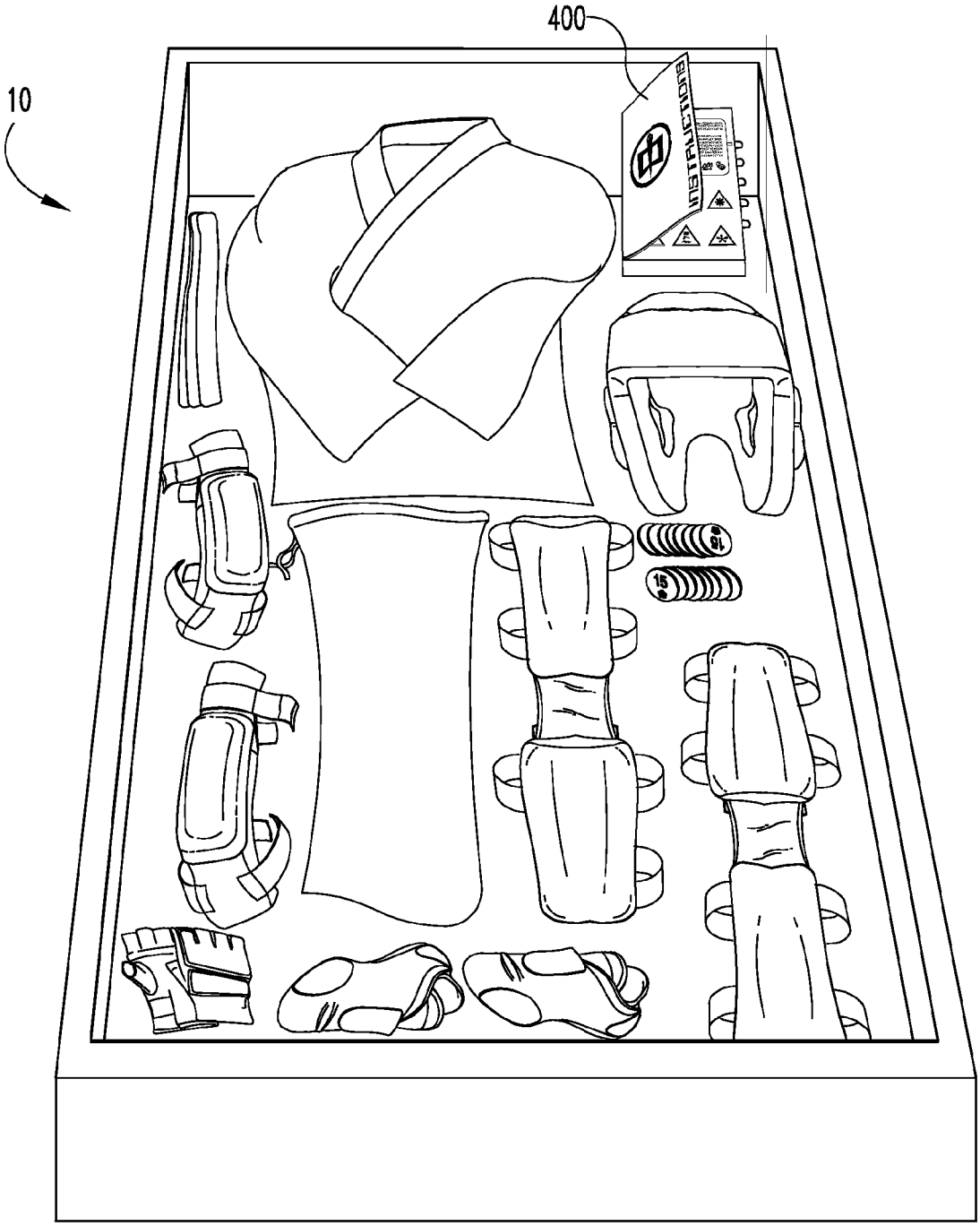
FIG. 4 is a perspective view of the elements of FIGS. 1-3 assembled in a kit, along with instructions.

As shown in FIG. 4, the various gloves 115, booties 140, guards 170, 190, helmet 240, garment 250, 260 and flags 300, along with instructions for game play 400 memorializing the rules of combat as discussed above, may be included as a kit 10.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a sub combination.

Similarly, while actions are depicted in the drawings or specification as occurring in a particular order, this should not be understood as requiring that such actions be performed in the particular order shown, or that all actions be performed, to achieve desirable results.

Thus, particular embodiments of the subject matter have been described. Other embodiments are within the scope of the following claims. In some cases, the actions recited in the claims can be performed in a different order and still achieve desirable results.

Additionally, the instant invention has been shown and described herein in what is considered to be the most practical and preferred embodiment. It is recognized, however, that nigh-infinite departures may be made therefrom within the scope of the invention and that obvious modifications will occur to a person skilled in the art.

What is claimed is:

1. A method for scoring martial arts combat, comprising:

equipping respective combatants each with a combat garment, the combat garment covering at least one strike zone, wherein a portion of the combat garment is covered with a first fastener suitable for disengageable contact fastening with a strike coin;

equipping each respective combatant with strike gear, wherein a portion of the strike gear is covered with a second fastener suitable for disengageable contact fastening with a strike coin;

equipping at least one combatant with at least one strike coin having a personalized logo disengagably engaged to at least one strike zone;

initiating a combat session wherein each respective combatant participates in the combat session; and generating a respective score for each respective combatant based upon a sum of strike coins, each of the strike coins disengagably contact fastened with the strike gear upon the combatant;

wherein the at least one strike coin is disengagably contact fastened with the first fastener and the second fastener;

wherein the at least one strike coin is more adhesive to the second fastener than with the first fastener; and wherein each respective combatant wins and retains after the combat any strike coins disengaged from an opponent during combat after combat has concluded.

2. The method of claim 1 wherein each respective strike coin is assigned a color associated with a respective strike location.

3. The method of claim 1 wherein the first fastener is a hook and loop type fastener.

4. The method of claim 3 wherein fastener density is greater on the strike gear than on the combat garment.

5. The method of claim 1 wherein each respective strike coin has a point value associated with a respective strike location to which it is fastened.

6. The method of claim 1 wherein the strike coin has a personal logo.

7. The method of claim 1 wherein generating a score further comprises calculating a handicap value for at least one combatant.

8. A method of playing a game, comprising the steps of:

equipping a first participant with a first garment, first strike gear, and a plurality of respective first strike coins having a personalized logo, each respective first strike coin disengagably contact fastened to the first garment, and each respective first strike coin capable of disengagably contact fastening to a second strike gear more fastly than to the first garment;

equipping a second participant with a second garment, the second strike gear, and a plurality of second strike coins having a personalized logo, each respective second strike coin disengagably contact fastened to the second garment, and each respective second strike coin capable of disengagably contact fastening to the first strike gear more fastly than to the second garment;

running a pre-determined number of rounds wherein the first participant attempts to acquire the second strike coins though physical contact of the first strike gear and respective second strike coins;

after each round, determining a round score for each respective participant, the round score substantially based upon the second strike coins attached to the first strike gear; and calculating a final score for each respective participant, the final score based upon a sum total of round scores;

wherein the personalized logo on the first strike coins is different from the personalized logo on the second strike coins;

wherein each respective participant wins and retains after the game strike coins captured during combat after combat has concluded.

9. The method of playing a game of claim 8 wherein each respective first strike coin is associated with a respective at least one strike location.

10. The method of playing a game of claim 9 wherein respective first strike coin is assigned a value based upon the respective at least one strike location with which the first strike coin is associated.

11. The method of playing a game of claim 9 wherein each respective first strike coin is assigned a respective color based upon the respective at least one strike location with which the first strike coin is associated.

12. The method of playing a game of claim 8 wherein a portion of each respective first strike coin is covered with hook and loop type fasteners.

13. The method of playing a game of claim 12 wherein a portion of the first gear is covered with hook and loop type fasteners.

14. A method for martial arts competition, comprising:

equipping respective combatants each with respective combat garments, each respective combat garment covering at least one strike zone, wherein at least a portion of each respective combat garment is covered with a first fastener suitable for disengageable contact fastening with a strike coin;

equipping each respective combatant with strike gear, wherein at least a portion each respective strike gear is covered with a second fastener suitable for disengageable contact fastening with a strike coin;

equipping at least one combatant with at least one strike coin disengagably engaged to at least one strike zone;

equipping at least one combatant with at least one strike coin having a unique personalized logo disengagably engaged to at least one strike zone;

initiating a combat session wherein each respective combatant participates in the combat session; and generating a respective score for each respective combatant based upon a sum of strike coins, each of the strike coins disengagably contact fastened with the strike gear upon the combatant;

wherein the at least one strike coin is disengagably contact fastened with the first fastener and the second fastener;

wherein the at least one strike coin is more adhesive to the second fastener than with the first fastener; and wherein each respective combatant wins and retains after the competition for future display any personalized strike coins disengaged from an opponent during combat after combat has concluded.

* * * * *